United States Patent [19]

Hanson

[11] 4,179,890

[45] Dec. 25, 1979

[54] EPITROCHOIDAL STIRLING TYPE ENGINE

[76] Inventor: Goodwin Hanson, 4640 W. 118th St., #218, Hawthorne, Calif. 90205

[21] Appl. No.: 893,956

[22] Filed: Apr. 4, 1978

[51] Int. Cl.[2] ..... F02G 1/04

[52] U.S. Cl. ..... 60/519; 418/60

[58] Field of Search ..... 60/517, 519; 418/60, 418/61 A, 61 B; 62/6

[56] References Cited

U.S. PATENT DOCUMENTS

| | | | |
|---|---|---|---|
| 3,270,718 | 9/1966 | Gassmann | 418/61 A |
| 3,426,525 | 2/1969 | Rubin | 60/519 |
| 3,763,649 | 10/1973 | Wahnschaffe | 60/519 |

*Primary Examiner*—Allen M. Ostrager

*Attorney, Agent, or Firm*—Albert M. Herzig; Edward C. Walsh

[57] ABSTRACT

An epitrochoidal Stirling type engine operating on a carnot cycle. The engine has a hot end and a cool end. Each end has a three-lobed rotary piston or rotor eccentrically mounted. Each rotor is in a four-lobed housing. Between the rotors, coaxially mounted is a cam similarly eccentrically mounted which is captured between peripherally mounted rollers so as to guide it in an orbit with precision. The cam is secured to the rotors so that they similarly orbit in precision in their housings to eliminate peripheral seals. Lobes of the two rotor housings are connected in pairs, the lobes of each pair being angularly spaced 90°. There are connections for fluid flow between pairs of lobes with regenerators in the connections. The thermodynamic cycle corresponds to that of the Stirling engine. Heat is applied to one end of the engine and heat is discharged at the other end. The engine produces a power output.

9 Claims, 7 Drawing Figures

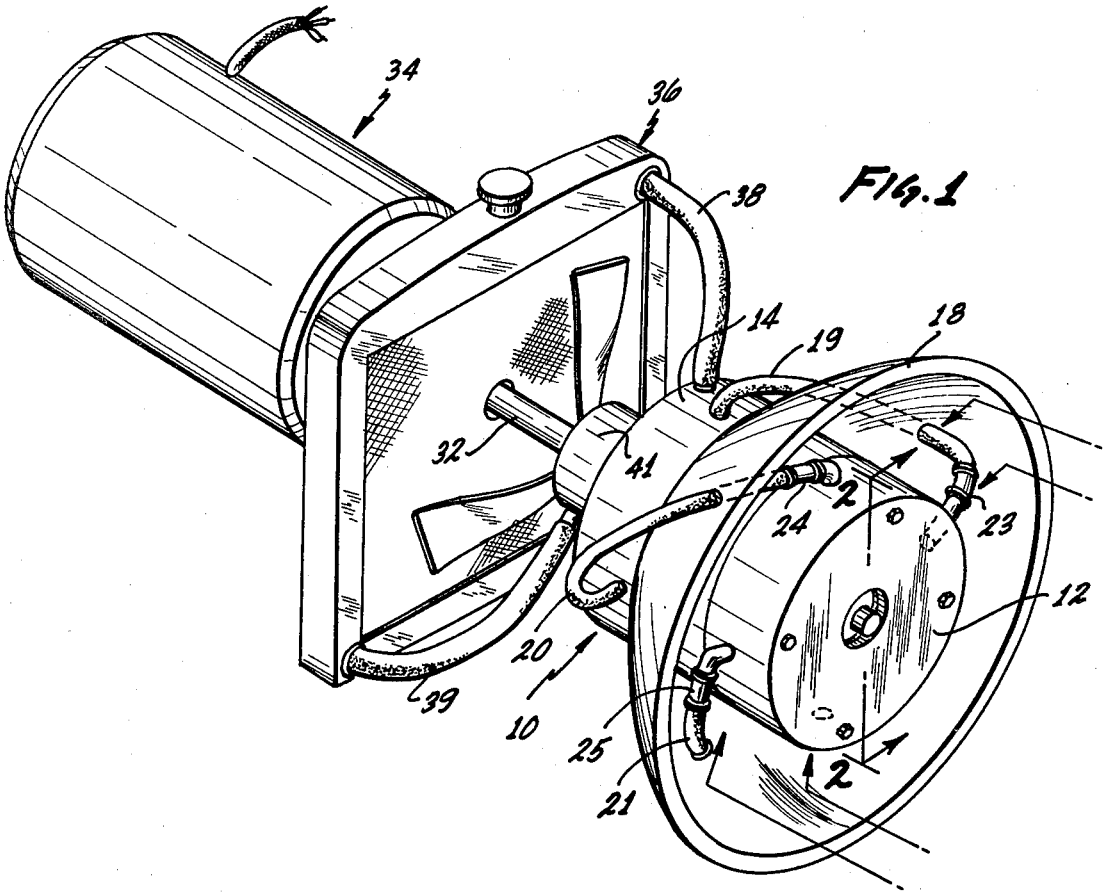
Fig. 1
Fig. 7
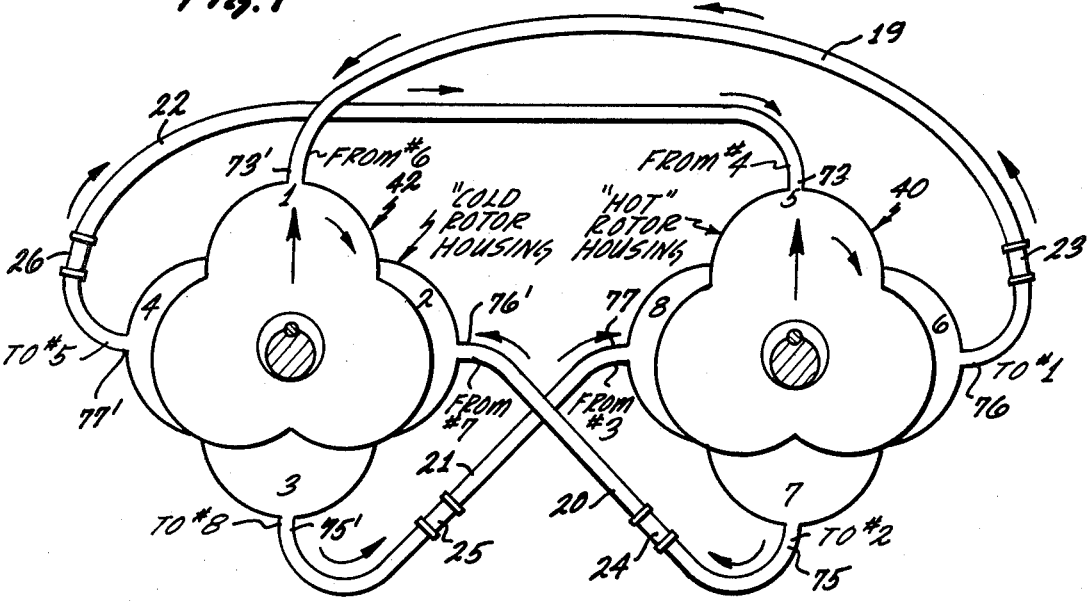

EPITROCHOIDAL STIRLING TYPE ENGINE

BACKGROUND OF THE INVENTION

1. Field of the Invention

The field of the invention is that of air engines not involving internal combustion. More particularly, the engine is a Stirling type air engine but such an engine using epitrochoidal rotors.

2. Description of the Prior Art

Significant examples of prior art which are relating to the Stirling type engine are as follows:

Article, Air Engines, The Engineer, April of 1959, pages 568–571.

Article, Air Engines, The Engineer, Apr. 3, 1959, pages 522–527.

Article, Popular Science, February, 1973, Stirling cycle engine—, February, 1973, pages 71–76.

The history of and the nature of Stirling cycle engines is explained in the foregoing literature and in other literature. Typically, the engines described in the literature are engines using receprocating pistons. A serious problem in such engines has been the sealing, the difficulties of sealing stemming from the inability to lubricate areas to be sealed because of the temperatures involved. With respect to prior art patents, reference is made to the following:

The U.S. Pat. Nos. 3,483,694; 3,426,525; 3,509,718; 3,763,649; 3,800,526; and 4,009,573. Typically the engines of these patents are described as hot gas rotary piston engines or rotary piston external combustion engines, etc.

The engine of U.S. Pat. No. 3,800,526 is described as a hot gas engine constructed as a rotary piston engine. The abstract describes it as a hot gas engine in the form of a rotary piston internal combustion engine of trochoidal type of construction. Although the construction is trochoidal, there is only one rotary piston and one piston chamber and the engine is not described as being a Stirling type engine.

Whereas the Stirling type air engines are known and they typically use reciprocating pistons, the prior art does not teach an engine of the Stirling type utilizing, instead of reciprocating pistons, rotary and lobed pistons operating in lobed chambers.

With respect to rotary piston engines as known in the prior art, they all require some type of sealing as between the rotary piston in its orbit and the interior of the rotor housing or piston chamber. Seals in these constructions are complex and difficult to be made effective. The inability or difficulty to provide sealing as between the rotary pistons and the interior of the rotor housing has been a drawback to constructions of this type. Thus, this has been a problem in the prior art which is overcome by the herein invention in a manner as described in detail hereinafter.

SUMMARY OF THE INVENTION

The invention is an air engine of the Stirling type in the sense that it operates on that type of cycle. The engine does not, however, utilize reciprocating pistons. Instead, there are provided a pair of epitrochoidal lobed rotary pistons or rotors eccentrically mounted in lobed rotor housings. Preferably the rotary pistons have three lobes mounted in four-lobed rotor housings.

The lobes of the two rotor housings are connected together in pairs, the lobes of these pairs being spaced angularly 90° apart. A flow of air takes place back and forth between the lobes of the pairs with regenerative means in the connections as is known in typical Stirling type engines.

Between the two rotors is a cam having the same shape as the rotary pistons and similarly eccentrically mounted. The cam is captured between peripheral rollers so as to constrain it to an orbit having precision. The cam is attached to both of the rotary pistons so that they move similarly in precision orbits within their respective rotor housings, this construction eliminating the need for seals between the periphery of the rotary housings. Instead, known types of carbon bellows seals are provided between side portions of the rotors and the housings.

One end of the engine is the cooler end and one end is the hot end. In the preferred exemplary form of the engine, the heat is provided by way of a solar absorber which may be a parabolic reflector surrounding the hot end of the engine. Heating is produced at the cooler end of the engine. The engine of the invention therefore adapts and accommodates itself to very basic needed types of utilization. In an exemplary form the engine would be mounted on a house or other building driving an electric generator for producing electrical power for the building, with heating being produced at one end of the engine. The heated water to cool engine would warm a house. Another application is that of utilizing the engine on a vehicle such as a car with the engine generating electrical power for moving the car, energy being stored in batteries. The engine is further adapted to being heated by way of burning fuels in the manner of known types of Stirling engines, using reciprocating pistons.

In the light of the foregoing, the primary object of the invention is to produce and realize an air engine of the Stirling type capable of being economically produced and effective for producing both power and heating.

A further object is to realize an engine as in the foregoing which is of the epitrochodial type, having lobed rotary pistons or rotors eccentrically mounted in lobed rotor housings with means whereby the need for peripheral sealing as between the rotors and the interior of the housings is eliminated, as in the roots type super charger.

A further object is to realize an engine as in the foregoing object wherein the purpose is achieved by way of cam means including a cam having a shape or contour corresponding to that of the rotors with means for constraining it into an orbit so that by coupling the cam to the rotary pistons the rotary pistons will follow precise orbints, not requiring peripheral sealing, with very slight clearance between the rotor and housing.

A further object is to realize an engine as in the foregoing wherein the rotary piston is a three-lobed rotor and the rotor housing is a four-lobed housing, the lobes of the pairs of lobes of the two rotor housings being spaced 90°.

Further objects and additional advantages of the invention will become apparent from the following detailed description and annexed drawings.

BRIEF DESCRIPTION OF THE DRAWINGS

FIG. 1 is a pictorial isometric view of the preferred form of the invention;

FIG. 7 is a diagrammatic view, diagrammitically illustrating the connections between pairs of the lobes of the two rotor housings.

DESCRIPTION OF THE PREFERRED EMBODIMENT

Figure 2:
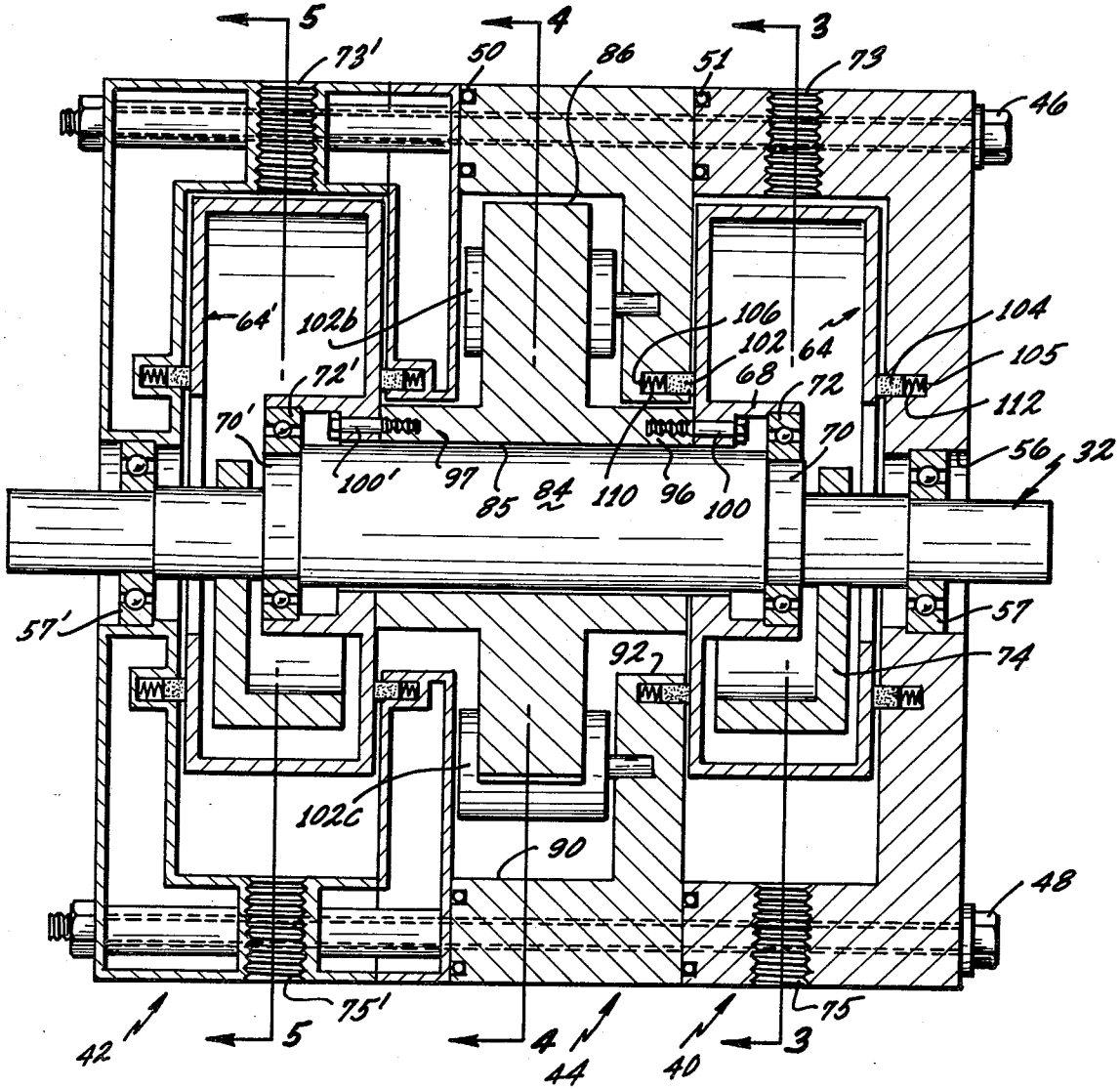
FIG. 2 is a cross-sectional view taken along line 2—2 of FIG. 1.

Referring to FIG. 1 of the drawings, the engine itself is identified by the numeral 10, having a hot end 12 and cold end 14 as in Stirling type engines. In the exemplary form shown, numeral 18 designates a solar absorber in the form of a parabolic reflector to receive light from the sun and to concentrate it on the hot end of the engine. Numerals 19, 20, 21 and 22 designate the connections for flow of air between pairs of lobes of the rotor housings of the engine as will be described more in detail hereinafter. In these connections, are provided regenerators 23, 24, 25 and 26. The regenerators can be like similar components as already known in the prior art. Also each might include heating and cooling means as known in the prior art or alternatively only cooling means.

The shaft of the engine is designated at 32. Mounted on the shaft is an electrical generator 34 for generating electrical power. Numeral 36, by way of example designates a radiator for cooling the end of the engine. The cooler end of the engine is connected to the radiator 36 by connections 38 and 39, jump 41 being included in the connections. The heat disappated in radiator 36 might otherwise be utilized for heating a building or other use.

FIG. 2 is a cross-sectional view taken along the line 2—2 of FIG. 1 illustrating the construction of the engine. The engine has a rotor housing 40 at the hot end, a corresponding rotor housing 42 at the cooler end and a cam housing member 44 in between rotor housings. The housings and the member are 44 and are secured together by through bolts such as shown at 46 and and 48. The housings are sealed together by way of sealing members such as shown at 50 and 51. Housing 42 is hollow as shown and liquid such as water is circulated through it to carry away heat.

Figure 3:
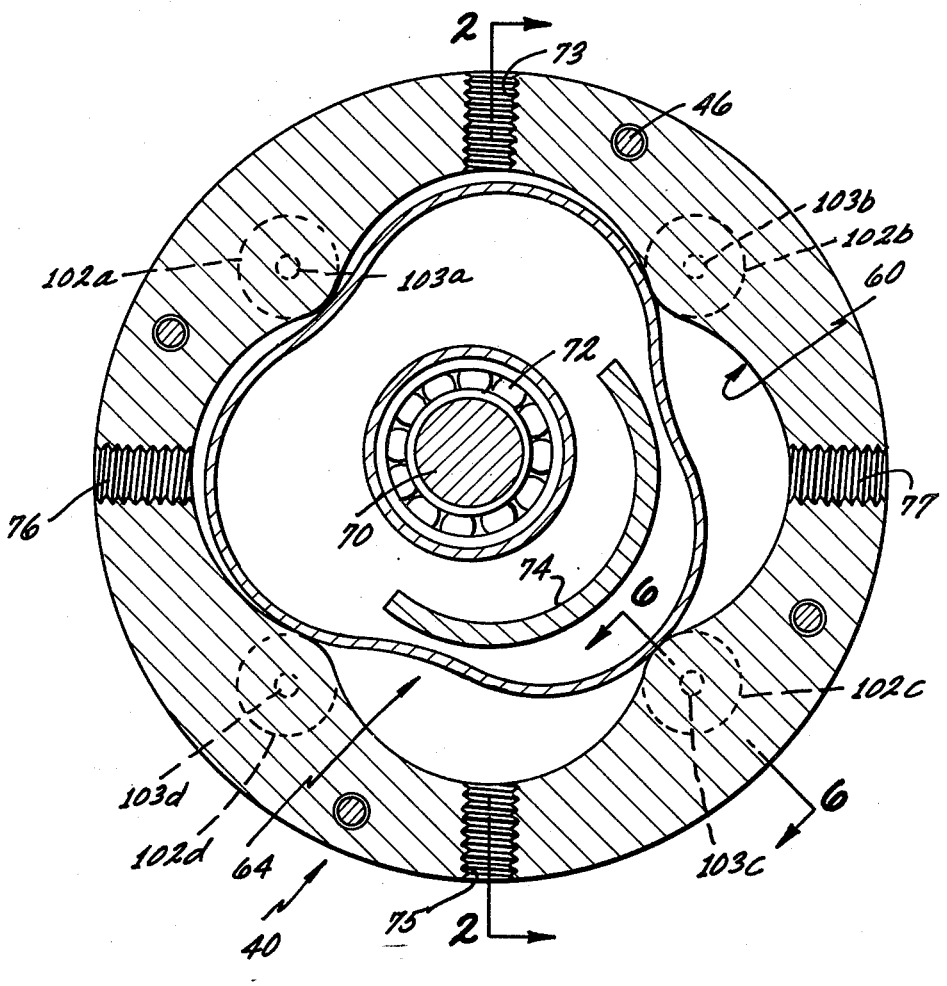
FIG. 3 is a cross-sectional view taken along line 3—3 of FIG. 2.

The rotor housing 40 and its rotor are shown in cross-section in FIG. 3. The housing 40 has an axial opening 56 in which is a bearing 57 in which the shaft 32 is journalled. The rotor housing 40 has an interior of epitrochoidal shape as identified by numeral 60, there being four similar lobes or depressions spaced 90° apart as shown.

Numeral 64 designates the rotary piston or rotor at the hot end. The rotor 64 is hollow as may be seen in FIG. 2 and is shaped to have three lobes spaced 120° apart as illustrated in FIG. 3, the shape being such that the lobes will conform to the lobes or depressions on the inside of the housing 40 as the rotor rotates. The rotor has an internal boss 68. The rotor is journaled on an eccentric part 70 of the shaft 32 by way of the bearing 72 in boss 68.

Numeral 74 designates a counter balancing mass carried on the shaft 32. The housing 40 has oppositely disposed openings 73 and 75 and oppositely disposed openings 76 and 77 to accommodate connections to corresponding lobes or depressions of the other rotor housing 42 as will be described. The sealing of the rotor 64 to the interior of the rotor housing 40 will be described presently.

Figure 4:
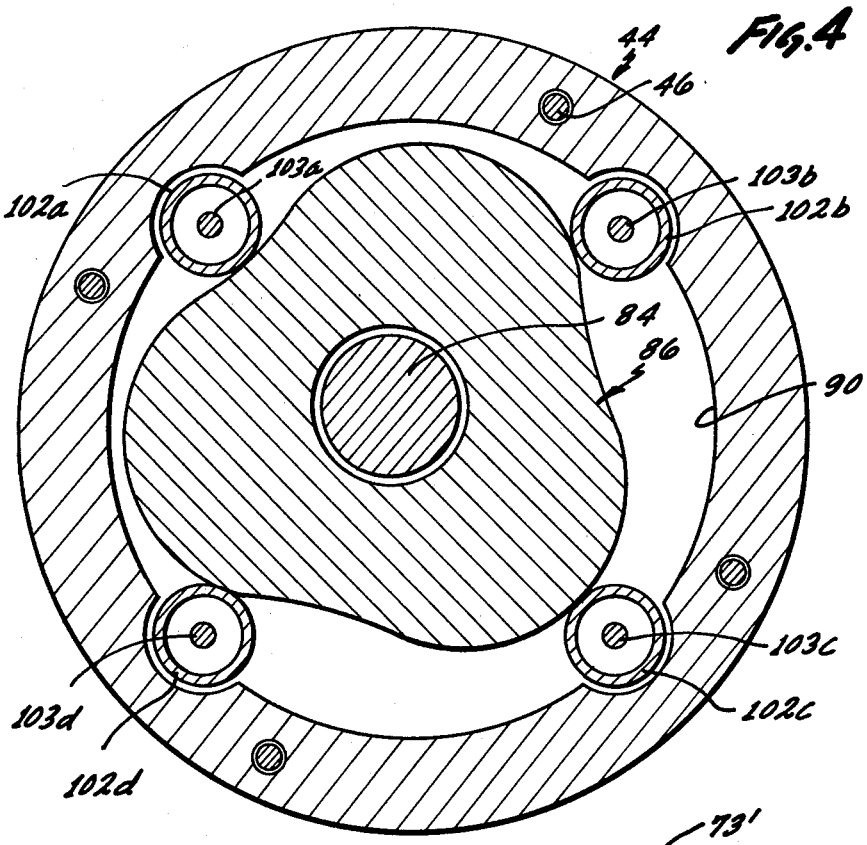
FIG. 4 is a cross-sectional view taken along line 4—4 of FIG. 2.

The other rotor is like the one just described and its parts are identified by corresponding reference numerals primed. The shaft 32 has an intermediate eccentric part 84 which is in bore 85 of a cam 86 which has the same shape as the rotors, that is of three-lobed construction. The cam housing 44 has circular recess 90 in it within which the cam 86 operates. See FIG. 4. The housing 44 has center opening 92 to accommodate the cam 86. Cam 86 has hubs 96 and 97, the rotor 64 being secured to the hub 96 by a bolt 100, the rotor 64' being secured to the hub 97 by bolts such as shown at 100'. The two rotors rotate with cam 86 or rather the cam rotates with the rotors.

The cam 86 is captured in the recess 90 in the cam housing 44 by rollers as designated at **102*a*, 102*b*, 102*c* and 102*d*. Each of these rollers is journaled on shafts as indicated at 103*a*, 103*b*, 103*c* and 103*d*, these shafts extending as cantilevers from the bottom surface of the recess 90**.

Figure 6:
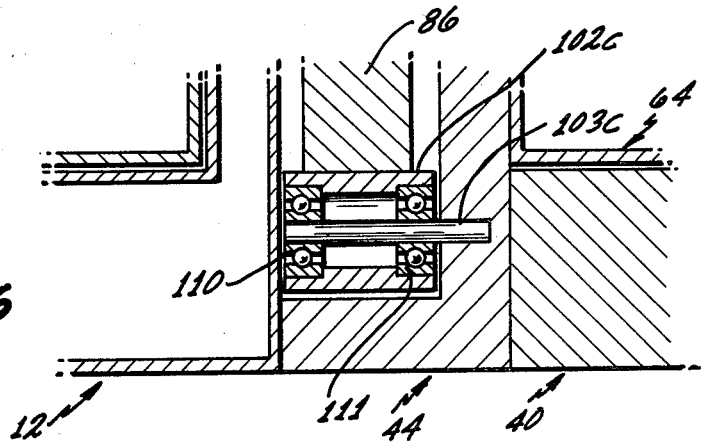
FIG. 6 is a cross-sectional view taken along line 6—6 of FIG. 3.

Each of the rollers such as the roller **102*c* as shown in FIG. 6 is mounted by way of ball bearings as designated at 110 and 111**.

Figure 5:
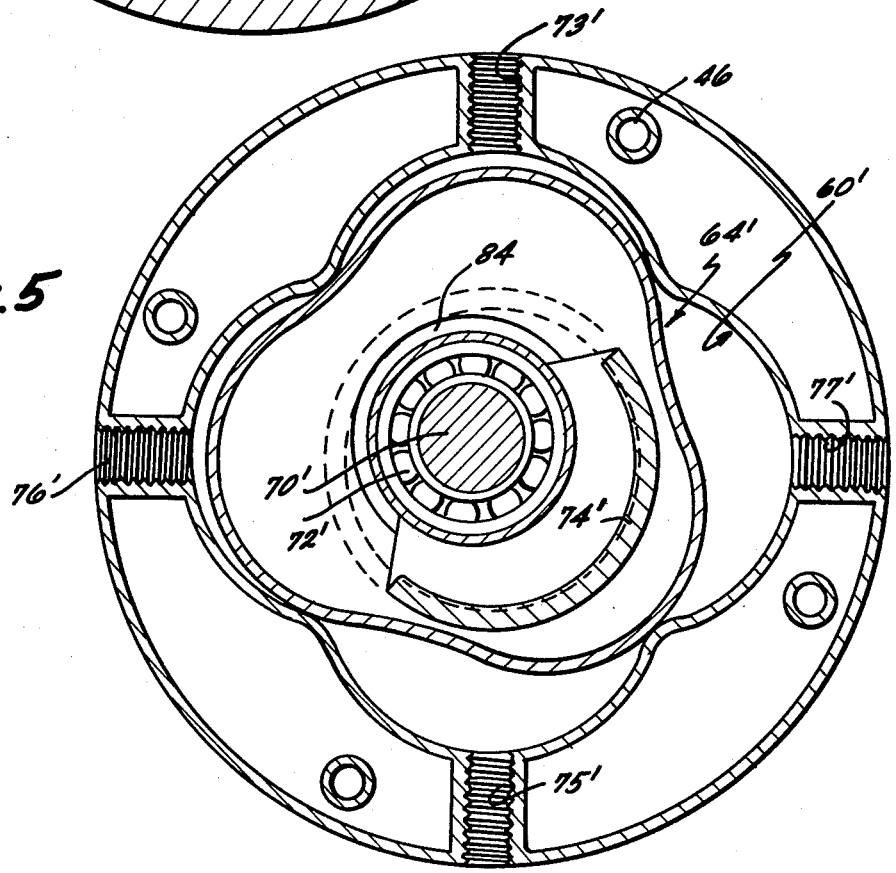
FIG. 5 is a cross-sectional view taken along line 5—5 of FIG. 2.

FIG. 5 is a sectional view taken along the line 5—5 through the rotor housing 42 and its rotor. This rotor and its housing are in all respects like that of the rotor and housing at the other end, which is the hot end.

FIG. 7 illustrates the connections 19, 20, 21 and 22 between the 90° ports in the respective rotor housings, 40 and 42. Lobes of the two rotor housings are connected in pairs as shown, spaced 90° apart. In the exemplary form of the invention as disclosed while the crank revolves 180° in a counter-clockwise direction, the rotor rotates 60° clockwise. The cam 86 is always in contact with the four rollers to insure precise and identical orbital movement and position of each of the two rotors. This construction is superior to the use of gears which would have backlash and would require lubrication by oil. Thus, each of the chambers in between the rotors and the interior of their respective housings increases and diminishes with exact precision without the need to have any sealing means between the peripheries of the rotors and the internal surface of the rotor housings.

There are no seals between the peripheries of the rotors and the interiors of the rotor housings. Rotor 64 is sealed on each side by carbon bellows seals including carbon rings 102 and 104 which are seated in angular grooves 106 and 105 in the rotor 40 and in the side of the cam housing 44, the carbon members being biased by bellows type springs as shown at 110 and 112. Rotor 64' is similarly sealed.

The other rotor is similarly sealed, the parts being identified by similar reference characters primed.

OPERATION

From the foregoing and from the references to the prior art literature those schooled in the art will readily understand the operation of the engine of the invention.

The volume of any pair chambers formed by lobes of the two rotor housings is constantly changing. In one revolution the air flows from a chamber or lobe of one pair to the corresponding lobe of that pair in the other rotor housing, these chambers being spaced by 90° as illustrated in FIG. 7. Heat is supplied to the hot end of the machine, that is to the rotor housing 40 as illustrated in FIG. 1 in the exemplary form of the invention although of course, heat could be supplied in many other ways.

The operation is best described with reference to one pair of rotor housing chambers which are angularly spaced 90°, with the air passing back and forth between these chambers. One chamber of the pair is, of course at the hot end of the engine and the other chamber is at the cooler end. The regenerators 21, 22, 23 and 24 can be coventional types capable of absorbing heat from air as it passes through them and transferring the heat back to the air as the air passes in the other direction. As the air passes towards the hot end through the regenerator, this hot air passing into the rotary chamber expands and drives the rotor around. The pressure pulse drives the rotor. As the rotor continues, it forces the air back through the regenerator to the cooler end. In passing to the cooler end, it gives up heat to the regenerator as it goes back to the cooler end. Its pressure is reducing and the volume is increasing at it passes into the chamber at the cooler end. When the air is transferred from the cooler end to the hot end, the volume is high and the pressure low.

Reference can be made to the diagrams in the article in The Engineer of Apr. 3, 1959, pg. 569, is incorporated herein by reference. This article includes a phase diagram of the cycle in an idealized Stirling cycle engine as well as pressure-volume and temperature-entropy diagrams for such engine. Corresponding diagrams for the herin invention would be basically similar, noting that the published diagrams are for an idealized engine. The idealized diagrams illustrate generally the shapes they would have and the relative changes in volume and temperature during a cycle, that would be present in other than an idealized engine including that described herein.

It is to be noted that four power pulses occur during each revolution of a rotary piston, the rotor housings having four lobes.

From the foregoing, those skilled in the art will understand the nature and the construction of the invention as well as its operation and possibilities of utilization. It is considered that the invention makes possible the direct coversion of solar energy into useful power and heat in an effective and economical way which is significant considering the contemporary needs for conservation of energy. In practicing the invention, various modifications and variations may be employed as regards to those parts of the invention that conform to or are similar to corresponding components already known to the prior art. That is, it is considered that different types of rotary pistons and piston housings might be employed utilizing the novel aspect of the cam means for precisely controlling and regulating the orbits of the rotary pistonrs. It is considered that the cam means might take other forms also as long as the function is realized of controlling the orbits of the rotary piston means in a manner to avoid the need for peripheral seals. As an example, the rotors might have four or five lobes operating in rotor housings having five or six lobes respectively.

The foregoing disclosure is representative of a preferred form or forms of the invention and is intended to be interpreted in an illustrative sense, the invention to be accorded to the full scope of the claims appended hereto.

I claim:

1. An engine having two epitrochoidal piston housings each having a plurality of lobes, a lobed rotary piston in each piston housing, a gas connection between each lobe of one piston housing and a lobe of the other piston housing for transfer of gas, shaft means for the rotary pistons, cam means associated with the shaft means and connected to the rotary pistons, the cam means being constructed for movement in a predetermined accurate orbit whereby the rotary pistons are constrained to the same accurate orbit within the respective piston housings.

2. An engine as in claim 1 wherein each lobe of one piston housing is connected to a lobe of the other piston housing, which is angularly spaced by 90° from the first piston housing.

3. An engine as in claim 1, wherein each piston housing has four lobes, each rotary piston having three lobes.

4. An engine as in claim 1, the cam means including a cam eccentrically mounted with respect to the shaft means and means positioned with respect to the periphery of the said cam to constrain the cam to said predetermined accurate orbit.

5. An engine as in claim 1, including regenerator means in the connections between the respective lobes of the piston housings.

6. An engine as in claim 2 including sealing means provided between side portions of the rotary pistons and the piston housings, the outer peripheries of the rotary pistons moving relative to the inside of the piston housings and being free from sealing therebetween.

7. An engine as in claim 4 when said means positioned with respect to the periphery of the said cam includes equi-angularly spaced roller means with which the cam engages.

8. An engine as in claim 4 wherein said cam is positioned in between the piston housings.

9. An engine as in claim 6 wherein said sealing means are carbon bellows seals providing sealing between the pistons and the piston housings.

* * * * *